US005988322A

United States Patent [19]

Kamimura et al.

[11] Patent Number: 5,988,322

[45] Date of Patent: Nov. 23, 1999

[54] ELEVATOR CAGE

[75] Inventors: Kousei Kamimura; Akira Motoe, both of Tokyo, Japan

[73] Assignee: Kabushiki Kaisha Toshiba, Kawasaki, Japan

[21] Appl. No.: 08/790,998

[22] Filed: Jan. 30, 1997

[30] Foreign Application Priority Data

Feb. 2, 1996 [JP] Japan ..... 8-017572

[51] Int. Cl.[6] ..... B66B 5/00

[52] U.S. Cl. ..... 187/345; 187/404

[58] Field of Search ..... 187/345, 346, 187/404, 411

[56] References Cited

U.S. PATENT DOCUMENTS

| | | | |
|---|---|---|---|
| 2,174,043 | 9/1939 | Scheibner | 187/346 |
| 5,005,671 | 4/1991 | Aime et al. | 187/345 |
| 5,020,639 | 6/1991 | Michel | 187/346 |
| 5,195,614 | 3/1993 | Hornyack et al. | 187/346 |
| 5,862,888 | 1/1999 | Iwakiri et al. | 187/345 |

OTHER PUBLICATIONS

R. Singh, et al. "Linear Analysis of Automotive Hydro–Mechanical Mount with Emphasis on Decoupler Characteristics", Journal of Sound and Vibration, 1992, 158(2), pp. 219–243.

Kazuto Seto, et al. "Optimum Design Method for Hydraulic Engine Mount", The Institute of Mechanical Engineers of Japan, (Nippon Kikai Gakkai), No. 900–42, Lecture Thesis of Symposium on the control of vibration and motion, Jul., 1990, pp. 31–36.

Toshihiko Kakimoto. "Hydro Elastic Engine Mounting Insulator", Technical Report of Nissan Co. (Nissan Gihou), (pp. 99–105), vol. 18, Dec., 1982.

*Primary Examiner*—William E. Terrell
*Assistant Examiner*—Khoi H. Tran
*Attorney, Agent, or Firm*—Oblon, Spivak, McClelland, Maier & Neustadt, P.C.

[57] ABSTRACT

An elevator cage including a cage frame, a cage chamber fixed on the cage frame, and a liquid vibration absorber fixed between the cage chamber and the cage frame. The liquid vibration absorber includes a first liquid chamber and a second liquid chamber, and the inner volumes of the first and second liquid chambers are variable according to elastic deformation, respectively. The liquid vibration absorber further includes an orifice portion communicating between the first and second liquid chambers and a liquid filled inside of the first and second liquid chambers and the orifice portion.

8 Claims, 6 Drawing Sheets

ELEVATOR CAGE

BACKGROUND OF THE INVENTION

1. Field of the Invention

This invention relates to an elevator cage, and more particularly to an elevator cage which can reduce the vibration transmitted to a cage chamber.

2. Description of the Related Art

FIG. 8 is an explanatory view showing one example of a conventional elevator cage and shows the state of an elevator cage guided by guide rails suspended in the hoistway.

In FIG. 8, a cage frame 2, of which details are omitted here, composing an elevator cage 1 is suspended by a main rope 5 between a pair of guide rails 6 formed in the T-shaped section that are provided vertically on the inner wall surfaces of the hoistway.

On a lower beam 2*a* at the lower end of age frame 2, four rubber vibration isolators 4 are fixed. A cage chamber 3, of which details are omitted here, is placed on rubber vibration isolators 4 in such a way that on the upper surfaces of rubber vibration isolators 4 the cage floor at the lower end of cage chamber 3 is placed.

There are rubber vibration isolators 7, of which details are omitted here, mounted symmetrically between the upper sides of cage chamber 3 and vertical beams 2*b* of cage frame 2, respectively.

At the left and right of the upper and lower ends of cage frame 2, guide rollers 8 are mounted symmetrically and are kept in contact with both sides and the top of guide rails 6, respectively. At the center of an upper beam 2*c* of cage frame 2, a main rope fixing bar (not shown) is penetrating upper beam 2*c*, and the lower end of main rope 5 is connected to the top end of this main rope fixing bar.

The upper end of main rope 5 is wound round a lifting wheel of a hoist (not shown) installed in a machine room formed on the top of the hoistway and then, hang down the hoistway. A balance weight (not shown) is attached to and is suspended from the other lower end of main rope 5.

In elevator cage 1 in this structure, the vibration is transmitted to lower beam 2*a* from guide rollers 8 rotating on guide rails 6. In order to reduce the vibration transmitted to cage chamber 3 from lower beam 2*a*, rubber vibration isolators 4 are incorporated into cage frame 2.

There are various causes for guide rollers 8 to vibrate, for instance, a slight difference in levels at the connecting portions of guide rails 6, slight meanders of guide rails 6. The vibration from a hoist that is transmitted from main rope 5 etc. is also transmitted to cage frame 2.

Therefore, rubber vibration isolators 4 are provided between lower beam 2*a* and the cage floor, and rubber material is also used for rubber vibration isolators 7 and guide rollers 8, thereby to reduce uncomfortable riding feeling of cage passengers.

For elevator cage 1 in such structure as described above, in particular, for elevator of which speed is accelerated at higher head, it is demanded to improve more comfortable riding quality by further reducing vibration transmitted to cage chamber 3.

SUMMARY OF THE INVENTION

Accordingly, one object of this invention is to provide an elevator cage which can reduce the vibration transmitted to a cage chamber.

Another object of this invention is to provide an elevator cage which can improve comfortable riding quality.

These and other objects of this invention can be achieved by providing an elevator cage including a cage frame, a cage chamber fixed on the cage frame, and a liquid vibration absorber fixed between the cage chamber and the cage frame. The liquid vibration absorber includes a first liquid chamber and a second liquid chamber, and the inner volumes of the first and second liquid chambers are variable according to elastic deformation, respectively. The liquid vibration absorber further includes an orifice portion communicating between the first and second liquid chambers and a liquid filled inside of the first and second liquid chambers and the orifice portion.

According to one aspect of this invention, there is provided an elevator cage including a cage frame, a cage chamber fixed on the cage frame, and a liquid vibration absorber fixed between the cage frame and a guide rail. The liquid vibration absorber includes a first liquid chamber and a second liquid chamber, and the inner volumes of the first and second liquid chambers are variable according to elastic deformation, respectively. The liquid vibration absorber further includes an orifice portion communicating between the first and second liquid chambers and a liquid filled inside of the first and second liquid chambers and the orifice portion.

According to another aspect of this invention, there is provided an elevator cage including a cage frame, a cage chamber fixed on the cage frame, and a liquid vibration absorber. The liquid vibration absorber includes a first liquid chamber fixed between the cage frame and the cage chamber at a first side of the cage chamber and a second liquid chamber fixed between the cage frame and the cage chamber at a second side of the cage chamber opposite to the first side, and the inner volumes of the first and second liquid chambers are variable according to elastic deformation, respectively. The liquid vibration absorber further includes an orifice tube communicating between the first and second liquid chambers and a liquid filled inside of the first and second liquid chambers and the orifice tube.

According to still another aspect of this invention there is provided an elevator cage including a cage frame, a cage chamber fixed on the cage frame, and a liquid vibration absorber. The liquid vibration absorber includes a first liquid chamber fixed between the cage frame and a first guide rail at a first side of the cage frame and a second liquid chamber fixed between the cage frame and a second guide rail at a second side of the cage frame opposite to the first side, and the inner volumes of the first and second liquid chambers are variable according to elastic deformation, respectively. The liquid vibration absorber further includes an orifice tube communicating between the first and second liquid chambers and a liquid filled inside of the first and second liquid chambers and the orifice tube.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
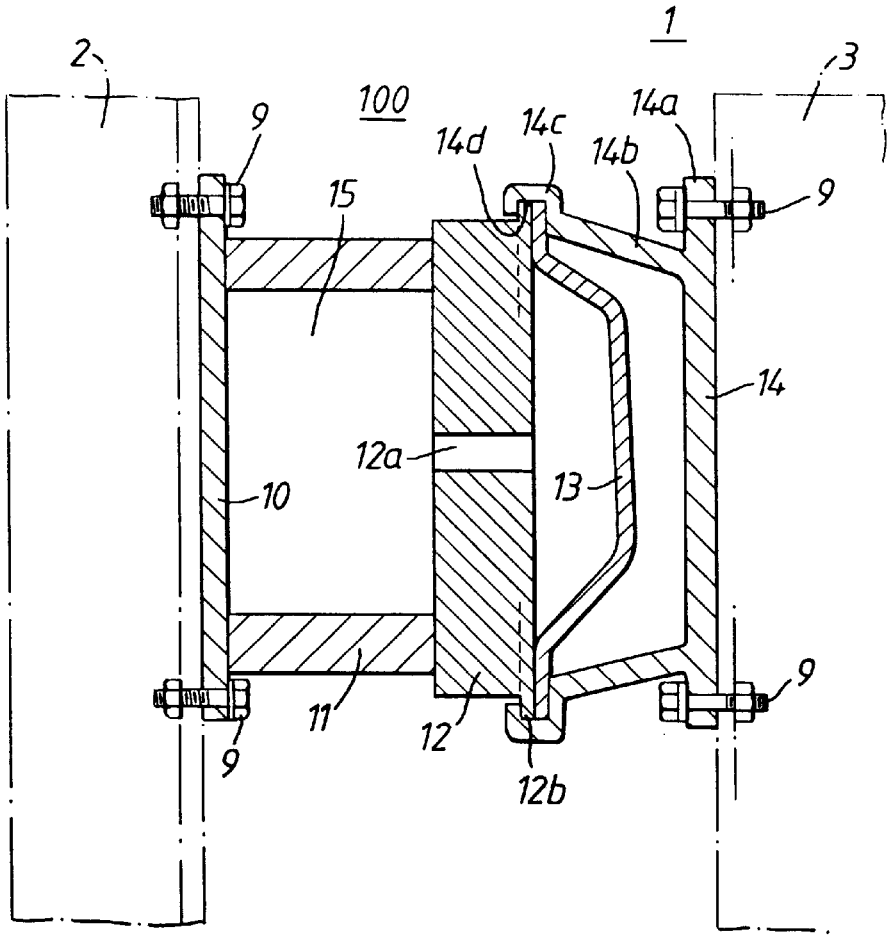
FIG. 1 is a partial vertical sectional view showing a part of an elevator cage according to a first embodiment of this invention.

Referring now to the drawings, wherein like reference numerals designate identical or corresponding parts throughout the several views, the embodiments of this invention will be described below.

Figure 8:
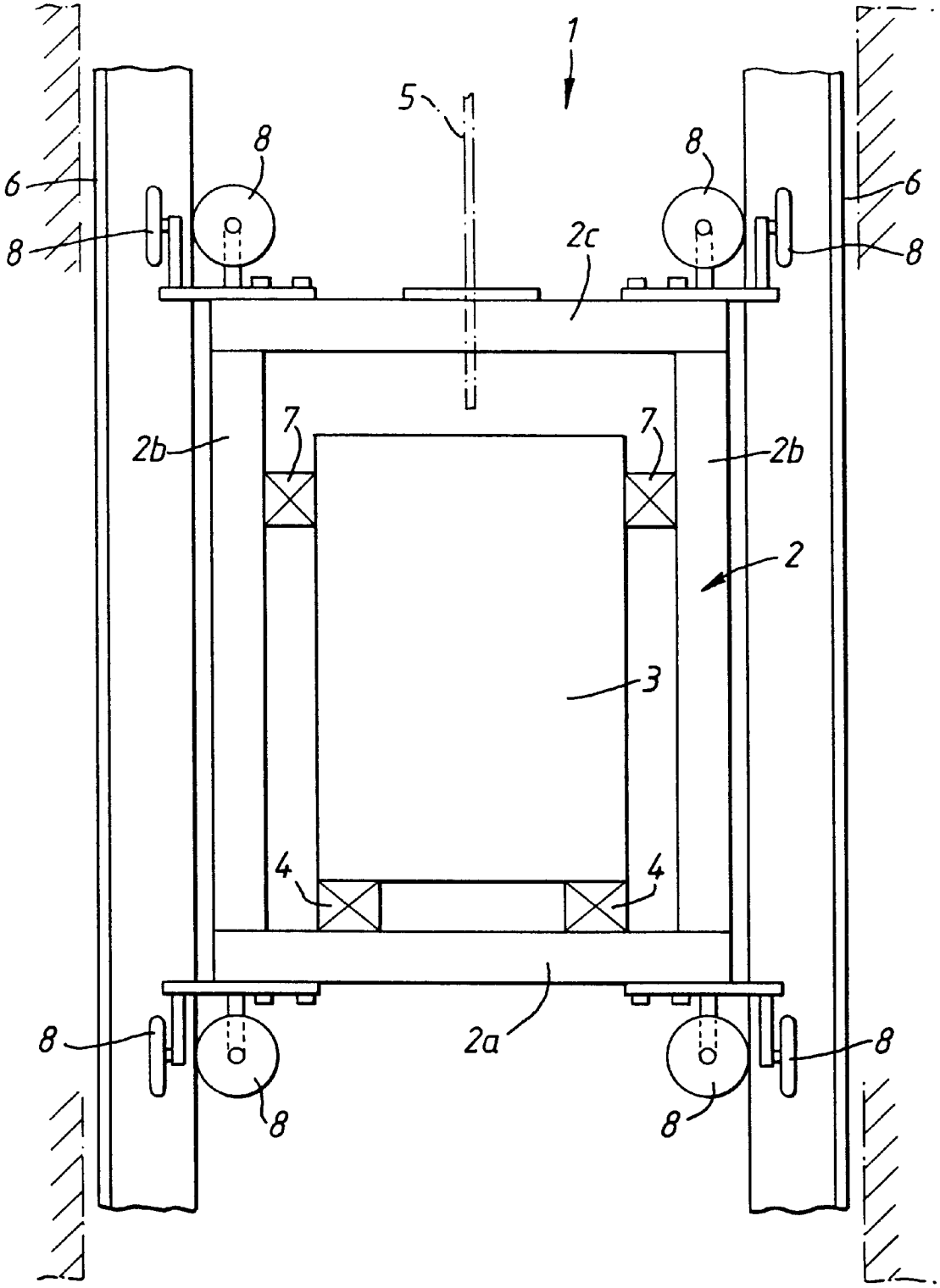
Fig. 8 (PRIOR ART)
FIG. 8 is a vertical sectional view showing one example of a conventional elevator cage.

FIG. 1 is a partial vertical sectional view showing a part of an elevator cage according to a first embodiment of the present invention. In FIG. 1, instead of rubber vibration isolators 7 shown in FIG. 8, liquid vibration absorbers 100 are mounted between the upper parts of cage chamber 3 and cage frame 2, respectively.

That is, a disk shaped mounting seat 10 is bolted on cage frame 2 by bolts 9 at the side of cage chamber 3 of cage frame 2. To this mounting seat 10, one side of a cylindrical rubber tube 11 is pre-joined.

To the other side of this rubber tube 11, one side of a disk shaped orifice plate 12 is joined. At the center of this orifice plate 12, an orifice hole 12*a* is formed. A flange portion 12*b* is provided on the circumference of the other side of orifice plate 12 while projecting therefrom.

On the other hand, at the upper cage frame 2 side of cage chamber 3, a flange portion 14*a* of a frame 14 made of mild steel plate in approximately π-shaped section is fixed to cage chamber 3 by bolts 9. At the top opening side of a cylindrical portion 14*b* of this frame 14, a flange portion 14*c* in the U-shaped section is formed. At an inner surface of flange portion 14*c*, a groove 14*d* is formed in the ring shape.

The peripheral portion of a diaphragm 13 made of rubber material, which is shown in a ship bottom shape in the sectional view in FIG. 1 and in a disk shape in the side view (not shown), is inserted into groove 14*d* at cylindrical portion 14*b* side of this groove 14*d*. Furthermore, flange portion 12*b* of orifice plate 12 is also inserted into groove 14*d* at cage frame 2 side of groove 14*d*.

Here, a first liquid chamber is formed in cylindrical rubber tube 11, and a second liquid chamber is formed between disk shaped orifice plate 12 and diaphragm 13.

The inside of rubber tube 11, orifice hole 12*a* and diaphragm 13 is filled with ethylene glycol 15 that is a low viscous antifreezing fluid.

In liquid vibration absorber 100 of elevator cage 1 in this structure, vibration transmitted from cage frame 2 to cage chamber 3 can be reduced by ethylene glycol 15 filled in rubber tube 11 and diaphragm 13 which are made of elastic rubber and orifice hole 12*a* communicating ethylene glycol 15 between rubber tube 11 and diaphragm 13.

Figure 2:
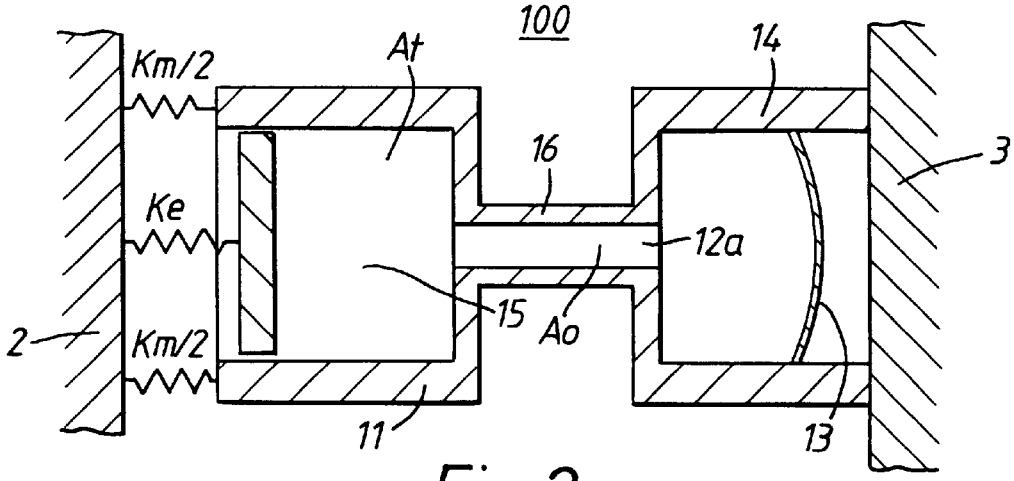
FIG. 2 is an explanatory diagram showing the action of the elevator cage shown in FIG. 1.

FIG. 2 is an explanatory diagram for explaining the action of elevator cage 1 constructed as shown in FIG. 1.

In FIG. 2, cage frame 2 and cage chamber 3 are supported by springs km and ke by rubber tube 11 at the side of cage frame 2. The inside of diaphragm 13 at the right side, the inside of rubber tube 11 at the left side and the inside of orifice hole 12*a* are filled with ethylene glycol 15 that is a non-compressible liquid. The viscosity of this liquid is assumed to be c.

Further, it is assumed that mass of liquid in an orifice portion 16 is mo, masses of liquid at cage chamber 3 side and cage frame 2 side are respectively mc and mf, displacement of liquid in orifice portion 16 is xo, displacements of liquid at cage chamber 3 side and cage frame 2 side are xc and xf. It is further assumed that the sectional area of the first liquid chamber connected by spring ke is At and that of orifice portion 16 is Ao. Then, the equation of motion relating to liquid masses of the liquid chamber and orifice portion 16 are expressed as follows:

$$mc\cdot xc''=km(xc-xf)+ke(x-xc)$$

$$mo\cdot xo''=(Ao/At)\cdot ke(x-xc)-c\cdot xo'$$

$$x=xf-(Ao/At)xo \tag{1}$$

Here, mark ' expresses the first stage differential (dx/dt) of displacement x by time t, and mark " expresses the second stage differential ($d^2x/dt^2$) of displacement x by time t, respectively.

By the way, as xc'<<xo' as is clear from FIG. 2, the equation of motion relating to mass of liquid in orifice portion 16 is given as follows:

$$meq\cdot xo''\approx(At/Ao)ke\cdot(x-xc)ceq\cdot(xo'-xc')$$

$$meq=(At/Ao)^2\cdot mo,$$

$$ceq=(At/Ao)^2\cdot c \tag{2}$$

It is found from equation (2) that an equivalent mass meq and an equivalent attenuation ceq are expanded to square-time $(At/Ao)^2$ of the cross-sectional area ratio of orifice portion 16 and liquid chamber. As a result, according to this liquid vibration absorber, the same vibration reducing effect is displayed as a normal dynamic vibration absorber with less mass than that of the normal dynamic vibration absorber.

Further, as clear from the equations (1) and (2), it is possible to use this liquid vibration absorber of this embodiment as an attenuator in addition to the use as a dynamic vibration absorber depending on ratio At/Ao of sectional areas of orifice portion 16 and the liquid chamber, the length of orifice portion 16 and the magnitude of liquid viscosity c.

Furthermore, in this embodiment, in the same phase parallel moving mode, as xc'(≈xf')<<xo', a velocity acting on attenuation is larger than the velocity when mounting a normal attenuator between cage chamber 3 and cage frame 2. As a result, according to liquid vibration absorber 100 a vibration reducing effect larger than a conventional attenuator shown in FIG. 8 can be obtained.

Therefore, on elevator cage 1 in such the structure as described above, it is possible to directly attenuate vibration of cage chamber 3 by mounting liquid filled dynamic vibration absorbers corresponding to natural vibration of cage chamber 3 between cage chamber 3 and cage frame 2, which is different from a spring or a damper acting on relative displacement or relative velocity between cage chamber 3 and cage frame 2.

Further, it is possible to increase the vibration reducing effect on cage chamber 3 by increasing relative displacement or relative velocity between cage chamber 3 and cage frame 2 by mounting elastic rubbers ke and km shown in FIG. 2 at cage frame 2 side and by using conventional under-floor vibration absorbing members and top-of-cage vibration absorbing members.

Further, in the above embodiment, although an example to provide mounting seat 10 to cage frame 2 side and frame 14 to the cage chamber 3 side is described, the entirety of them may be mounted by reversing the left and the right.

Figure 3:
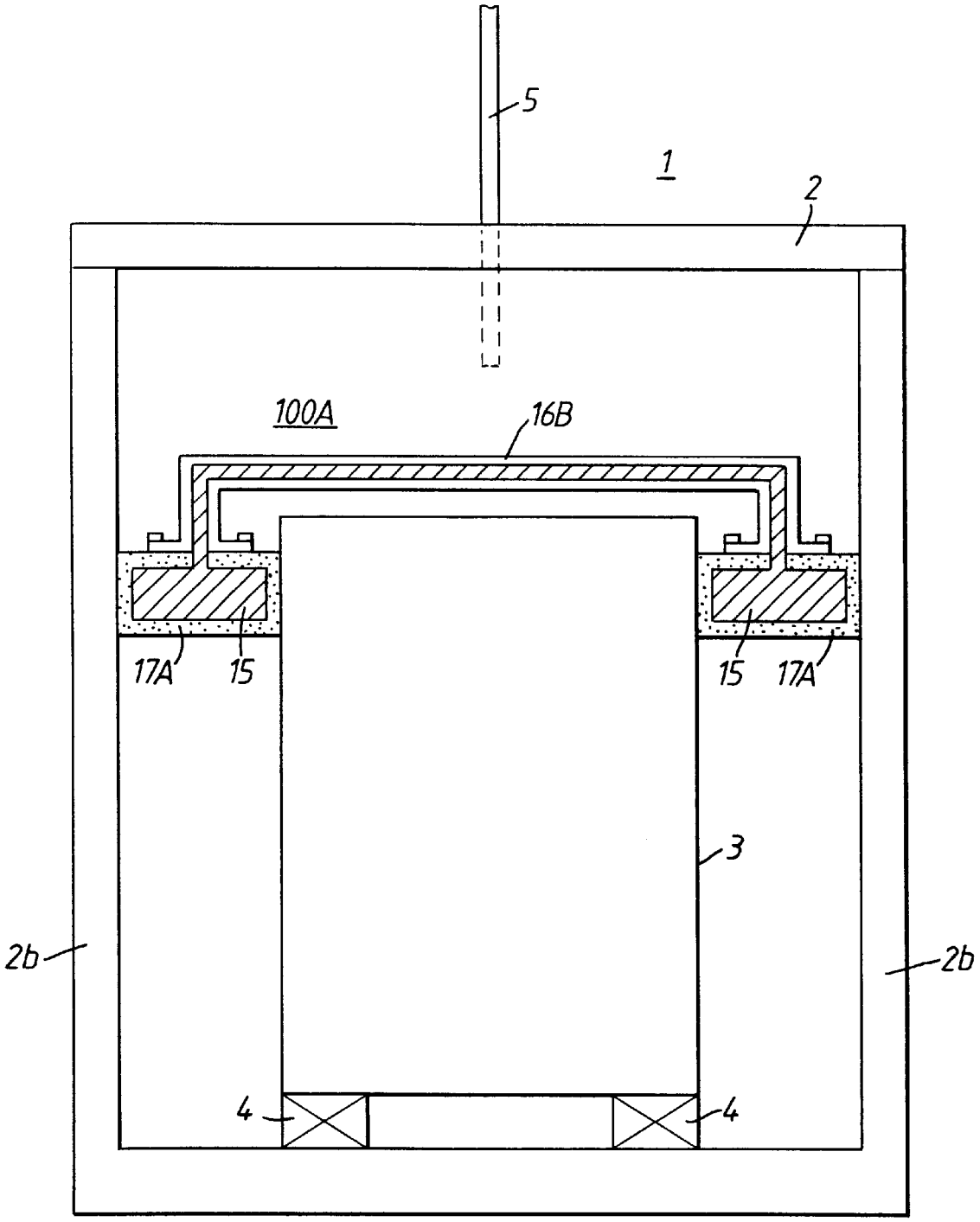
FIG. 3 is a vertical sectional view showing an elevator cage according to a second embodiment of this invention.

Next, FIG. 3 is a vertical sectional view showing an elevator cage according to a second embodiment of the present invention, and shows the entirety of cage frame 2 and cage chamber 3.

In FIG. 3, there are provided, between cage chamber 3 and vertical beams 2*b*, rectangular rubber containers 17A also in a rectangular shape in a plan view (not shown) at both the upper left and right sides of cage chamber 3. These left and right rubber containers 17A are connected by an orifice tube 16B in a small diameter provided transversely above cage chamber 3.

These rubber containers 17A and orifice tube 16B are filled with ethylene glycol 15 likewise the embodiment shown in FIG. 1.

Even in a liquid vibration absorber 100A of elevator cage 1 in the structure described above, mass of ethylene glycol 15 in orifice tube 16B and amount of attenuation in orifice tube 16B are expanded to square-times of the ratio of sectional areas of rubber container 17A and orifice tube 16B, and liquid vibration absorber 100A acts as a dynamic vibration absorber as well as an attenuator. As a result, it becomes possible to attenuate vibration transmitted from cage frame 2 to cage chamber 3 sharply.

Figure 4:
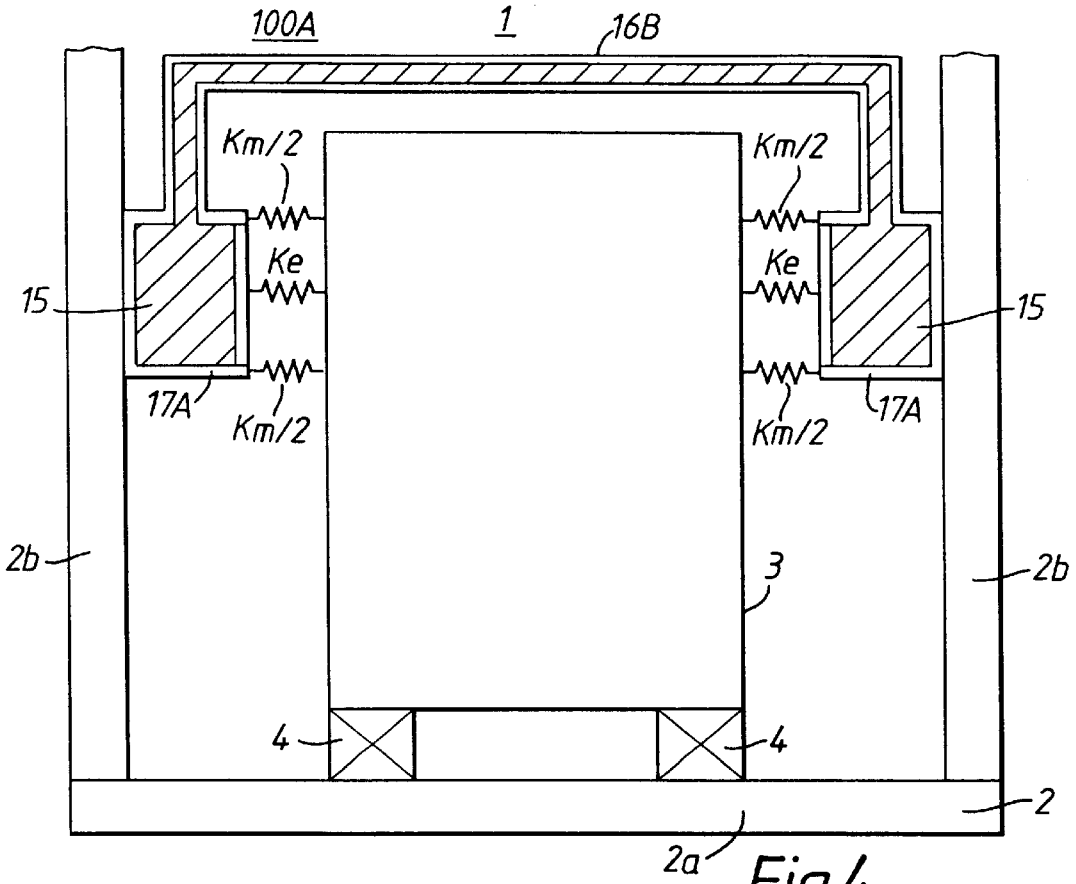
FIG. 4 is an explanatory diagram showing the action of the elevator cage shown in FIG. 3.

FIG. 4 is a schematic diagram for explaining the action of elevator cage 1 constructed as shown in FIG. 3, which corresponds to FIG. 2.

In FIG. 4, there are also springs ke and km by rubber containers 17A between the left and right vertical beams 2b and cage chamber 3 likewise the embodiment shown in FIG. 2.

Figure 5:
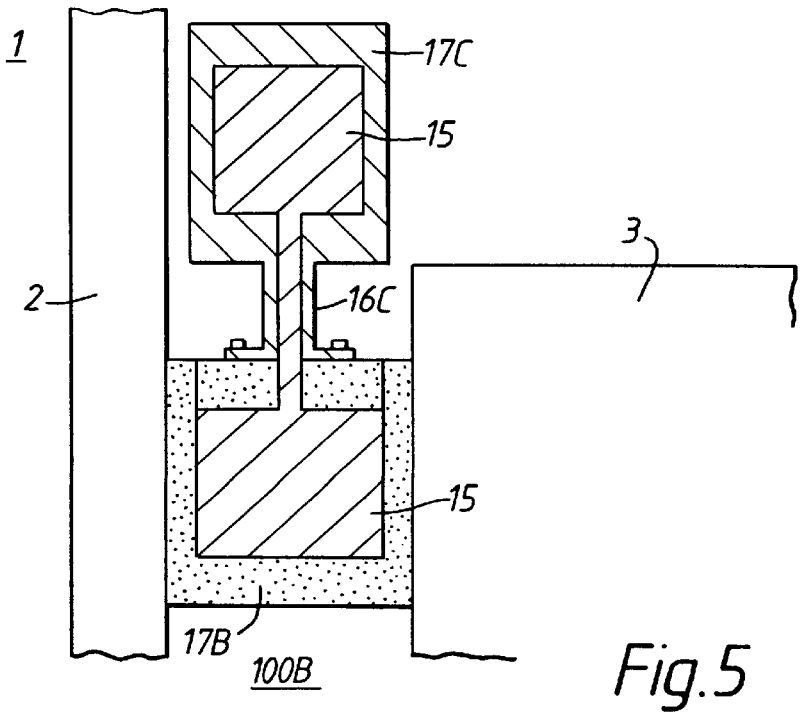
FIG. 5 is a partial vertical sectional view showing a part of an elevator cage according to a third embodiment of this invention.

Next, FIG. 5 is a partial vertical sectional view showing a part of an elevator cage according to a third embodiment of the present invention corresponding to FIG. 1.

In FIG. 5, what is differing from liquid vibration absorber 100 shown in FIG. 1 is that there are liquid chambers at the upper and lower sides, which are connected by an orifice tube 16C in a liquid vibration absorber 100B.

That is, in FIG. 5, in liquid vibration absorber 100B, there is provided a rubber container 17B between the upper side of cage chamber 3 and cage frame 2 likewise FIG. 3 and a second container 17C is connected to the upper part of this rubber container 17B via orifice tube 16C.

The inner space of these rubber containers 17B and 17C and orifice tube 16C is filled with ethylene glycol 15 as in the embodiment shown in FIG. 1.

In liquid vibration absorber 100B of elevator cage 1 in the structure as described above, mass of ethylene glycol 15 in orifice tube 16C and amount of attenuation in orifice tube 16C are also expanded to square-times of the ratio of sectional areas of rubber container 17B and orifice tube 16C. As a result, it is possible to further promote the vibration reducing effect.

Figure 6:
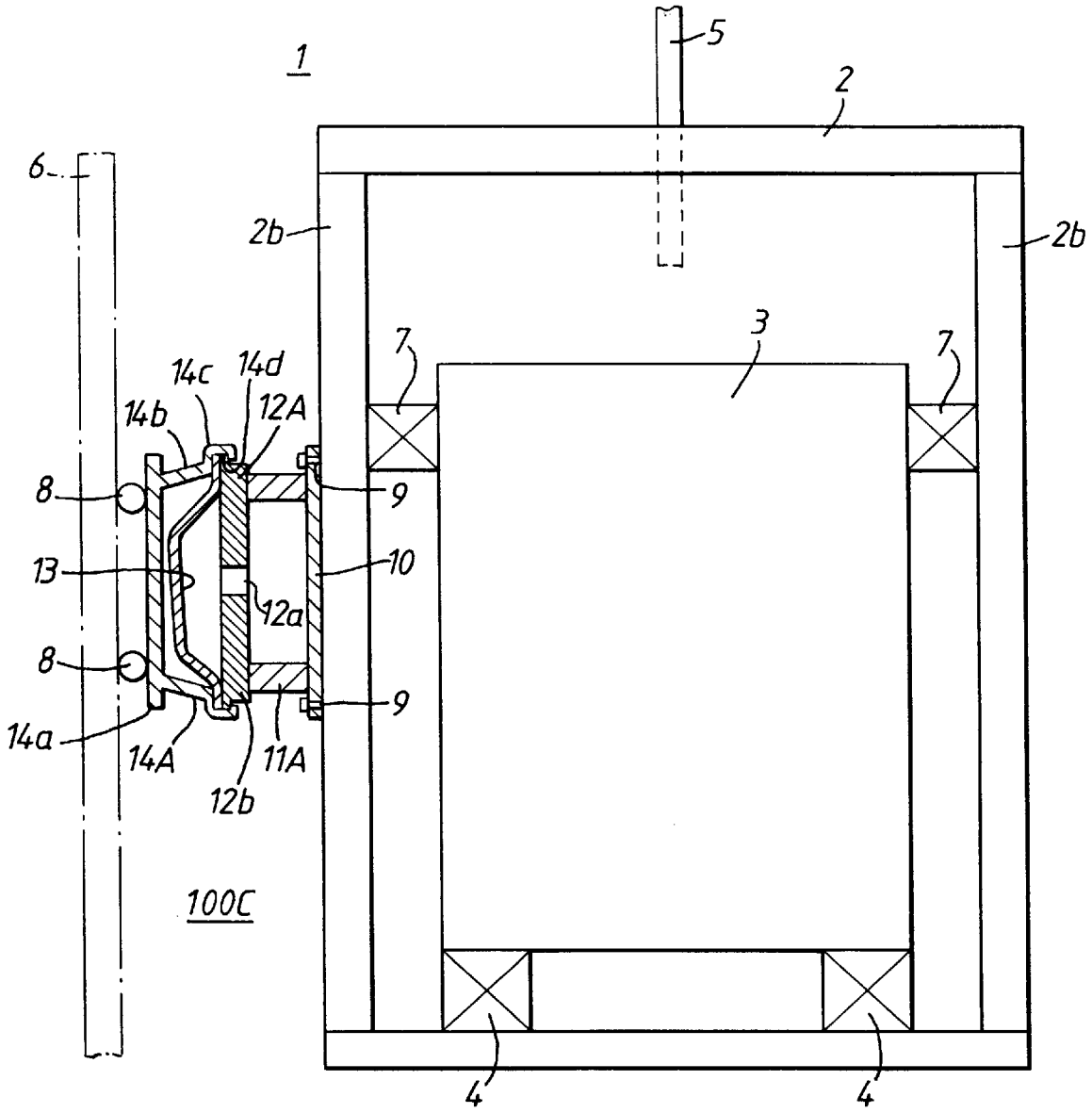
FIG. 6 is a partial vertical sectional view showing a part of an elevator cage according to a fourth embodiment of this invention.

Next, FIG. 6 is a partial vertical sectional view showing a part of an elevator cage according to a fourth embodiment of the present invention, corresponding to FIG. 1.

In FIG. 6, a liquid vibration absorber 100C in the almost same shape as liquid vibration absorber 100 shown in FIG. 1 is provided between guide rollers 8 which rotate on guide rail 6 and cage frame 2. Liquid vibration absorber lOOC also serves as a supporter of guide rollers 8.

That is, disk shaped mounting seat 10 is bolted on cage frame 2. To this mounting seat 10, one side of a cylindrical rubber tube 11A is pre-joined.

At the other side of this rubber tube 11A, one side of a disk shaped orifice plate 12A is joined. At the center of this orifice plate 12A, an orifice hole 12*a* is formed and on the peripheral portion of the other side of orifice plate 12A, a flange portion 12*b* is formed while projecting therefrom.

A frame 14A made of mild steel plate in approximately 7z-shaped section is provided. At the top opening side of cylindrical portion 14*b* of this frame 14A, flange portion 14C in the U-shaped section is formed. At an inner surface of flange portion 14C, groove 14 is formed in the ring shape. The peripheral portion of diaphragm 13 made of rubber material, which is shown in a ship bottom shape in the sectional view shown in FIG. 6 but in a disk shape in the side view (not shown), is inserted into groove 14*d* at cylindrical portion 14*b* side of groove 14*d*. Furthermore, flange portion 12*b* of orifice plate 12A is also inserted into groove 14*d* at guide rail 6 side of groove 14*d*.

The inside of rubber tubes 11A, orifice hole 12*a* and diaphragm 13 is filled with ethylene glycol 15 which is a low viscous antifreezing fluid.

Guide rollers 8 are mounted rotatably to flange portion 14*a* of frame 14A via a pair of supporting metals (not shown) and these guide rollers 8 are kept in contact with both sides and top of each guide rail 6, respectively.

In liquid vibration absorber 100C of elevator cage 1 in the structure as described above, it is possible to reduce vibration transmitted from guide rail 6 to cage frame 2 by ethylene glycol 15 filled in rubber tubes 11A and diaphragms 13 which are made of elastic rubber and orifice hole 12*a* communicating ethylene glycol 15 between rubber tube 11A and diaphragm 13.

Further, in FIG. 6, mounting seat 10 may be mounted at the guide rail 6 side and other component parts may be assembled reversely.

Figure 7:
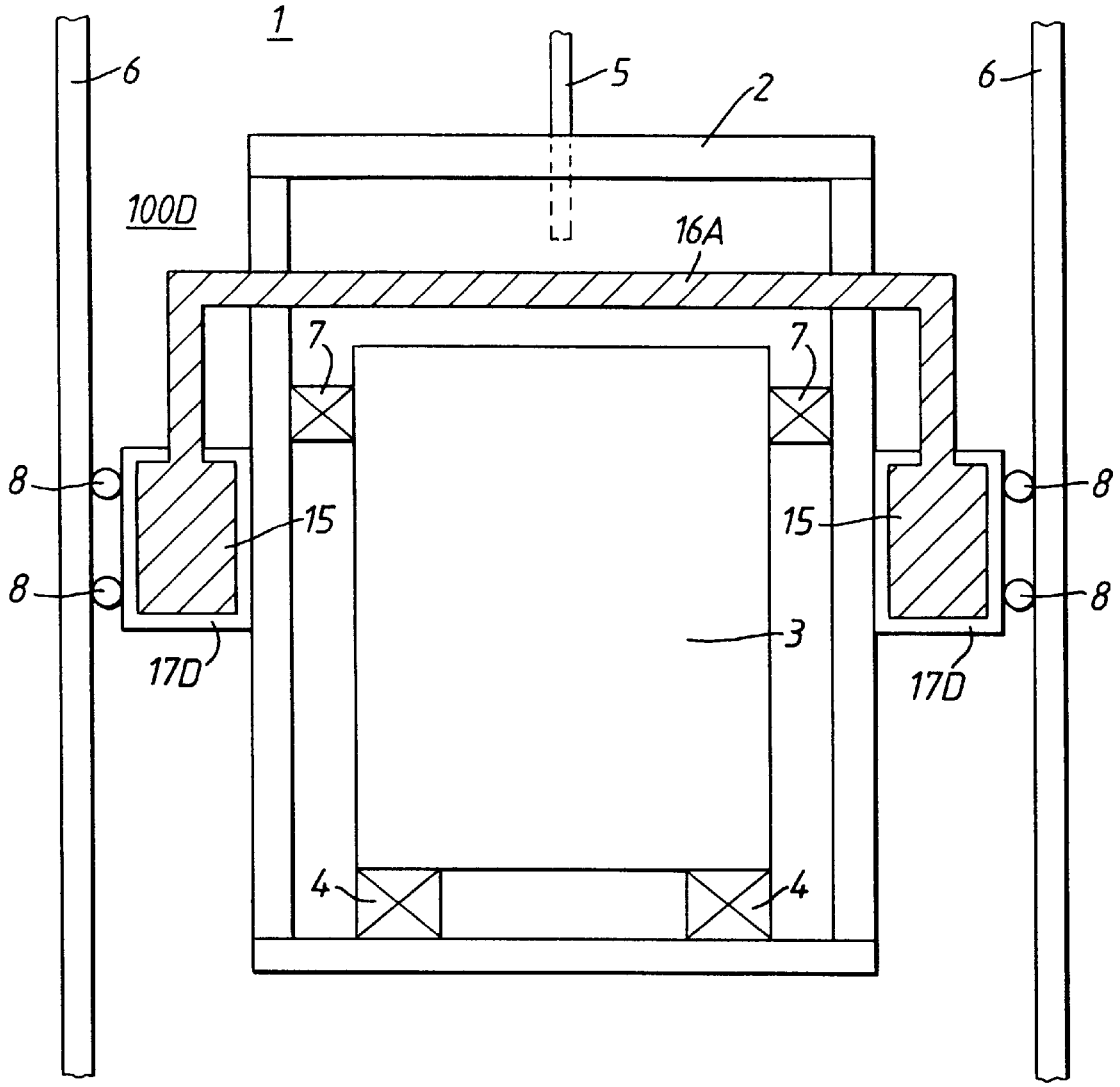
FIG. 7 is a vertical sectional view showing an elevator cage according to a fifth embodiment of this invention.

Next, FIG. 7 is a vertical sectional view showing an elevator cage according to a fifth embodiment of the present invention corresponding to FIG. 3, and shows the entirety of cage frame 2 and cage chamber 3.

In FIG. 7, there are provided, between cage frame 2 and guide rails 6, rectangular rubber containers 17D also in a rectangular shape in a plan view (not shown) at both sides of cage frame 2. These left and right rubber containers 17D are connected by an orifice tube 16A in a small diameter provided horizontally above cage chamber 3.

These rubber containers 17D and orifice tube 16A are filled with ethylene glycol 15 likewise the embodiments shown in FIG. 3.

At guide rail 6 side of each of rubber container 17D, guide rollers 8 are mounted rotatably via a pair of supporting metals (not shown) and these guide rollers 8 are kept in contact with the both sides and top of each guide rail 6.

In a liquid vibration absorber 100D of elevator cage 1 in the structure as described above, mass of ethylene glycol 15 in orifice tube 16A and amount of attenuation in orifice tube 16A are expanded to square-times of the ratio of sectional areas of rubber container 17D and orifice tube 16A, and liquid vibration absorber 100D acts as a dynamic vibration absorber as well as an attenuator. As a result, it is possible to attenuate vibration transmitted from guide rails 6 to cage frame 3 sharply.

As described above, according to this invention, as vibration transmitted from a cage frame to a cage chamber is attenuated by a liquid vibration absorber provided between the cage frame and the cage chamber, it is possible to obtain an elevator cage which can reduce the vibration transmitted to the cage chamber.

According to this invention, as vibration transmitted from guide rails to a cage frame is attenuated by a liquid vibration absorber provided between the cage frame and the guide rails, it is possible to obtain an elevator cage which can reduce the vibration transmitted to the cage chamber.

According to this invention, as vibration transmitted from guide rollers to a cage frame is attenuated by a liquid vibration absorber provided between the cage frame and the guide rails and guide rollers mounted on the liquid vibration absorber, it is possible to obtain an elevator cage which can reduce the vibration transmitted to the cage chamber.

According to this invention, as vibration transmitted to the cage chamber is reduced, it is possible to obtain an elevator cage which can improve comfortable riding quality.

Obviously, numerous modifications and variations of the present invention are possible in light of the above teachings. It is therefore to be understood that within the scope of the appended claims, the invention may be practiced otherwise than as specifically described herein.

What is claimed is:

1. An elevator cage, comprising:

a cage frame;

a cage chamber supported on said cage frame; and a liquid vibration absorber fixed between said cage fame and said cage chamber;

said liquid vibration absorber including, a first liquid chamber defining an inner volume, said first liquid chamber having an elastically deformable wall, a second liquid chamber having an elastically deformable diaphragm, the inner volume of said first liquid chamber being variable according to elastic deformation of the elastically deformable wall of the first liquid chamber, an orifice portion in liquid communication with said first and second liquid chambers, and a liquid tilled inside of said first and second liquid chambers and said orifice portion.

2. The elevator cage according to claim 1, wherein said liquid vibration absorber further includes:

a mounting seat fixed on one of said cage frame and said cage chamber;

a cylindrical rubber tube formed by said elastically deformable wall;

a disk shaped orifice plate with an orifice hole bored through said orifice plate at the center thereof;

a tubular frame fixed to the other one of said cage frame and said cage chamber at a bottom portion thereof, said elastically deformable diaphragm being provided in a tubular portion of said tubular frame; and an antifreezing fluid as said fluid;

wherein a first side of said cylindrical rubber tube is jointed to said mounting scat and a second side of said cylindrical rubber tube is jointed to a first side of said disk shaped orifice plate, thereby to form said first liquid chamber in said cylindrical rubber tube;

a top opening side of said tubular frame is fixed to a second side of said disk shaped orifice plate to form said tubular portion;

a top opening side of said diaphragm is also fixed to said second side of said disk shaped orifice plate to divide said tubular portion, thereby to form said second liquid chamber between said disk shaped orifice plate and said diaphragm; and said antifreezing fluid is filled inside of said first and second liquid chambers and said orifice portion in said orifice hole.

3. An elevator cage according to claim 1 wherein:

said first liquid chamber is fixed between said cage frame and said cage chamber at a first side of said cage chamber, said second liquid chamber is fixed between said cage frame and said cage chamber at a second side of said cage chamber opposite to said first side, said orifice portion comprises an orifice tube communicating between said first and second liquid chambers, and said liquid is filled inside of said orifice tube.

4. An elevator cage, comprising:

a cage frame;

a cage chamber supported on said cage frame; and a liquid vibration absorber fixed between said cage frame and a guide rail;

said liquid vibration absorber including, a first liquid chamber defining an inner volume, said first liquid chamber having an elastically deformable wall, a second liquid chamber having an elastically deformable diaphragm, the inner volume of said first liquid chamber being variable according to elastic deformation of the elastically deformable wall of the first liquid chamber, an orifice portion in liquid communication with said first and second liquid chambers, and a liquid filled inside of said first and second liquid chambers and said orifice portion.

5. The elevator cage according to claim 4, further comprising:

a plurality of guide rollers mounted on one of said first and second liquid chambers which is positioned on said guide rail side;

each of said guide rollers being rotatable while kept in contact with said guide rail.

6. The elevator cage according to claim 5, wherein said liquid vibration absorber further includes:

a mounting seat;

a cylindrical rubber tube formed by said elastically deformable wall;

a disk shaped orifice plate with an orifice hole bored through said orifice plate at the center thereof;

a tubular frame said elastically deformable diaphragm being provided in a tubular portion of said tubular frame; and an antifreezing fluid as said fluid;

wherein a first side of said cylindrical rubber tube is jointed to said mounting seat and a second side of said cylindrical rubber tube is jointed to a first side of said disk shaped orifice plate, thereby to form said first liquid chamber in said cylindrical rubber tube;

a top opening side of said tubular frame is fixed to a second side of said disk shaped orifice plate to form said tubular portion;

a top opening side of said diaphragm is also fixed to said second side of said disk shaped orifice plate to divide said tubular portion, thereby to form said second liquid chamber between said disk shaped orifice plate and said diaphragm;

said antifreezing fluid is filled inside of said first and second liquid chambers and said orifice portion in said orifice hole;

said guide rollers are fixed on one ot said mounting seat and a bottom portion of said tubular frame; and the other one of said mounting seat and said bottom portion of said tubular frame is fixed on said cage frame.

7. An elevator cage according to claim 4, wherein:

said first liquid chamber is fixed between said cage frame and a first guide at a first side of said cage frame, said second liquid chamber is fixed between said cage frame and a second guide at a second side of said cage frame opposite to said first side, said orifice portion comprises an orifice tube communicating between said first and second liquid chambers, and said liquid is filled inside of said orifice tube.

8. The elevator cage according to claim 7, further comprising:

a plurality of first guide rollers mounted on said first liquid chamber; and a plurality of second guide rollers mounted on said second liquid chamber;

each of said first guide rollers being rotatable while kept in contact with said first guide; and each of said second guide rollers being rotatable while kept in contact with said second guide.

* * * * *